US011583076B2

(12) United States Patent
Kinney

(10) Patent No.: US 11,583,076 B2
(45) Date of Patent: Feb. 21, 2023

(54) BABY CARRIER STORAGE ASSEMBLY

(71) Applicant: Arthur Demoine Kinney, Conyers, GA (US)

(72) Inventor: Arthur Demoine Kinney, Conyers, GA (US)

( * ) Notice: Subject to any disclaimer, the term of this patent is extended or adjusted under 35 U.S.C. 154(b) by 43 days.

(21) Appl. No.: 17/313,881

(22) Filed: May 6, 2021

(65) Prior Publication Data

US 2021/0345772 A1 Nov. 11, 2021

Related U.S. Application Data

(60) Provisional application No. 63/020,684, filed on May 6, 2020.

(51) Int. Cl.
*A47B 45/00* (2006.01)
*A47B 81/00* (2006.01)
*A47B 96/06* (2006.01)

(52) U.S. Cl.
CPC ..... *A47B 81/00* (2013.01); *A47B 45/00* (2013.01); *A47B 96/06* (2013.01)

(58) Field of Classification Search
CPC ..... A47B 81/00; A47B 45/00; A47B 96/06; F16B 45/00; F16M 11/041; F16M 11/10; F16M 13/00; F16M 13/022; F16M 2200/024
USPC ..... 248/304
See application file for complete search history.

(56) References Cited

U.S. PATENT DOCUMENTS 1,445,179 A * 2/1923 Seymour ..... A47B 23/04 248/452
2,235,182 A * 3/1941 Weston ..... B65B 67/1255 248/100
3,139,045 A * 6/1964 Rojakovick ..... A47B 43/003 108/147.11
4,108,084 A * 8/1978 Fink ..... A47B 61/003 108/29
4,426,011 A * 1/1984 Jay ..... A47B 96/061 211/193
4,448,384 A * 5/1984 Jones, Jr. ..... A47B 23/004 248/443
4,557,455 A * 12/1985 Benjamin ..... G09F 3/0323 248/496

(Continued)

*Primary Examiner* — Nkeisha Smith
(74) *Attorney, Agent, or Firm* — Bold IP, PLLC; Houda El-Jarrah; Randy Fenton

(57) ABSTRACT

A baby carrier storage assembly is provided. The assembly includes a base bracket with first and second elongate support members in overlapping arrangements with first and second telescoping support members, respectively, configured with the bracket on opposing sides. Attachment mechanisms are coupled to the top ends of the first and second elongate support members, and holding mechanisms are coupled to the lower ends of the first and second telescoping support members. The attachment mechanisms are adapted to attach the assembly to a separate structure, e.g., to the top of a door, and the holder mechanisms are adapted to attach a baby carrier to the baby carrier storage assembly. The length of the baby carrier storage assembly may be adjusted by setting the position of the first and second telescoping members with respect to the position of the first and second elongate support members, respectively.

20 Claims, 13 Drawing Sheets

(56) References Cited

U.S. PATENT DOCUMENTS 4,949,924 A * 8/1990 Carmody ..... A47G 7/044 248/215
5,542,314 A * 8/1996 Sullivan ..... B60R 11/0252 224/276
5,738,319 A * 4/1998 Grassi ..... A47G 7/044 248/215
5,779,206 A * 7/1998 Harris ..... A47B 96/06 248/214
5,813,354 A * 9/1998 Scott ..... B60N 3/004 297/146
6,168,125 B1 * 1/2001 Winger ..... A47H 1/144 248/48.1
6,575,416 B1 * 6/2003 Avinger ..... F16B 7/105 248/327
7,234,671 B2 * 6/2007 Avinger ..... A01G 5/04 248/339
7,448,688 B2 * 11/2008 Farah ..... A47C 16/02 297/217.7
7,887,017 B2 * 2/2011 Moran ..... B44C 5/00 248/339
7,992,833 B1 * 8/2011 Goodman ..... A47G 25/0614 248/339
8,240,626 B2 * 8/2012 Kennedy ..... B65F 1/1452 224/268
8,474,778 B2 * 7/2013 Jacobson ..... F16M 13/022 248/495
8,511,486 B2 * 8/2013 Mansor ..... A47B 96/063 211/117
8,622,488 B1 * 1/2014 Kilby ..... A47B 96/06 211/202
9,062,821 B2 * 6/2015 Jensen ..... F16M 11/041
9,701,253 B2 * 7/2017 Conlon ..... B60R 7/043
9,844,283 B2 * 12/2017 Bacallao ..... A47F 9/042
10,070,740 B2 * 9/2018 Jacobs ..... A47G 1/202
10,238,221 B2 * 3/2019 Kressin ..... F16M 11/046
10,458,594 B2 * 10/2019 Burton ..... F16M 11/2021
10,512,325 B2 * 12/2019 Mitchell ..... A47G 29/00
10,820,678 B2 * 11/2020 Karambatsos ..... A45D 20/12
2004/0051015 A1 * 3/2004 Ohrling ..... A47B 96/065 248/214
2006/0060738 A1 * 3/2006 Whittington ..... E04G 5/06 248/295.11
2007/0075213 A1 * 4/2007 Foser ..... E04C 2/428 248/216.1
2009/0294616 A1 * 12/2009 Eriksson-Bradley ..... A47G 1/202 248/305
2011/0049321 A1 * 3/2011 Wu ..... F16M 11/045 248/339
2014/0353267 A1 * 12/2014 Knutson ..... A47G 29/06 211/113
2019/0104874 A1 4/2019 Baines et al.
2019/0142197 A1 * 5/2019 McClendon ..... A47B 61/02 248/295.11

* cited by examiner

BABY CARRIER STORAGE ASSEMBLY

CROSS-REFERENCE TO RELATED APPLICATIONS

This application claims priority to U.S. Provisional Application No. 63/020,684 filed on May 6, 2020, the entire contents of which are hereby fully incorporated herein by reference for all purposes.

FIELD OF THE INVENTION

This invention relates to securing assemblies, including assemblies adapted to secure baby carriers to other structures.

BACKGROUND

Infant car seat carriers are used throughout the world due to the safety the carriers provide and their convenience of use. The carriers are used both as car seats to safely belt an infant within an automobile and as baby carriers to subsequently carry the baby outside.

However, while extremely safe and convenient, the infant car seat carriers are often large and bulky and are thereby difficult to store when not in use.

Accordingly, there is a need for a baby carrier storage assembly that may provide for the safe and convenient storing of a baby carrier when not in use, and for the easy access to the carrier when it is needed.

SUMMARY

In one aspect, a baby carrier holder assembly is provided comprising a base including a first side and a second side, a first support channel configured on the first side and a second support channel configured on the second side, a first elongate support member including a first end and a second end and configured within the first support channel and including at least one first detent, a second elongate support member including a first end and a second end and configured within the second support channel and including at least one second detent, a first telescoping support member including a first end and a second end and in a first overlapping arrangement with the first elongate support member within the first support channel, the first telescoping support member including at least one first shoulder adapted to releasably engage the at least one first detent, a second telescoping support member including a first end and a second end and in a second overlapping arrangement with the second elongate support member within the second support channel, the second telescoping support member including at least one second shoulder adapted to releasably engage the at least one second detent, a first attachment member coupled to the first end of the first elongate support member, and a second attachment member coupled to the first end of the second elongate support member, and a first holding member coupled to the second end of the first telescoping support member, and a second holding member coupled to the second end of the second telescoping support member, wherein the first and/or second attachment members are adapted to attach to a separate structure, and wherein the first and/or second holding members are adapted to attach to a baby carrier.

In another aspect, a baby carrier holder assembly is provided comprising a base including a first side and a second side, a first support channel configured on the first side and a second support channel configured on the second side, a first elongate support member including a first end and a second end and a portion between the first end and the second end configured within the first support channel, the first elongate support member including a first hook coupled to its first end and at least one first detent, a second elongate support member including a first end and a second end and a portion between the first end and the second end configured within the second support channel, the second elongate support member including a second hook coupled to its first end and at least one second detent, a first telescoping support member including a first end and a second end, its first end in a first overlapping arrangement with the first elongate support member within the first support channel, the first telescoping support member including at least one first shoulder adapted to releasably engage the at least one first detent and a third hook coupled to its second end, a second telescoping support member including a first end and a second end, its first end in a second overlapping arrangement with the second elongate support member within the second support channel, the second telescoping support member including at least one second shoulder adapted to releasably engage the at least one second detent and a fourth hook coupled to its second end, wherein the first hook and/or second hook is adapted to attach to a separate structure, and wherein the third hook and/or fourth hook is adapted to attach to a baby carrier.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

As used herein, unless used otherwise, the following terms and abbreviations have the following meanings:

Baby carrier refers to any type of human infant carrier including, without limitation, any type of infant car seat carrier that may be secured within an automobile and subsequently removed to carry an infant outside the vehicle, other types of baby carriers (preferably with at least one handle), and any combination thereof.

In general, the baby carrier storage assembly (also referred to as a holder) according to exemplary embodiments hereof includes an assembly for securing a standard baby carrier to another structure (e.g., to the back of a door). In this way, the assembly may provide a method of storing an associated baby carrier off the ground and in a convenient area when not in use. The assembly may generally include holding mechanisms to secure the baby carrier, and attachment mechanisms to configure the assembly with another structure.

In some embodiments, the baby carrier holder may be used to secure a baby carrier to the back of a door for storage. In other embodiments, the baby carrier holder may be used to secure a baby carrier to a coat rack. In other embodiments, the baby carrier holder may be used to secure a baby carrier other types of structures, and it is understood that the scope of the baby carrier is not limited in any way by the types of structures with which it is used.

Figure 1:
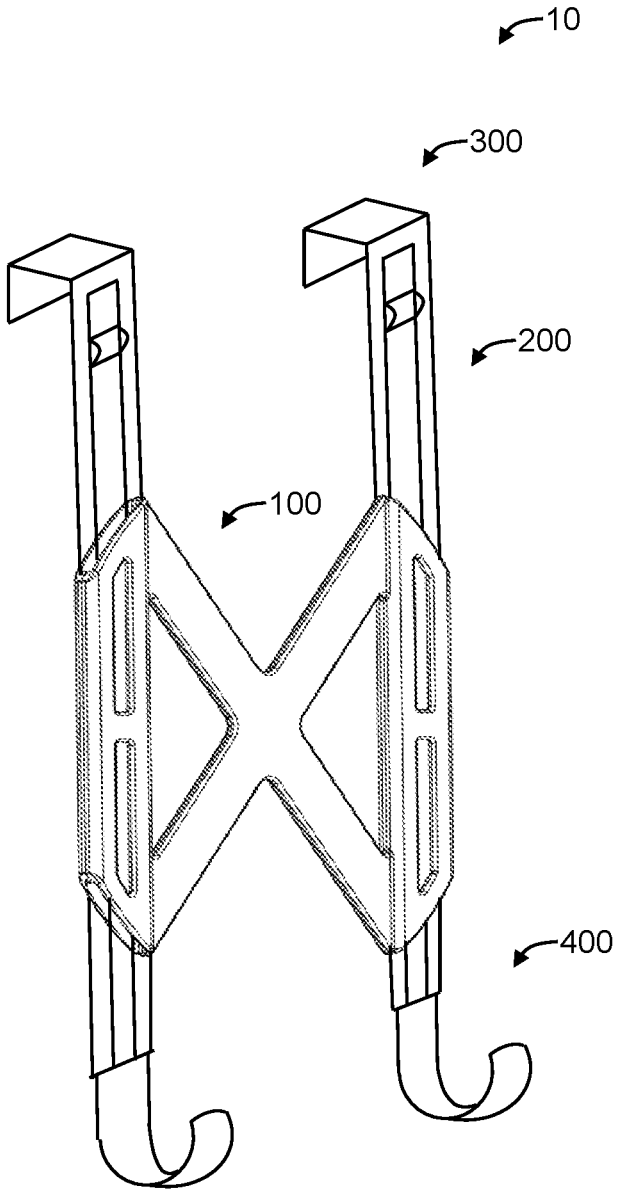
FIG. 1 shows aspects of a holder assembly according to exemplary embodiments hereof.

In one exemplary embodiment hereof, as shown in FIG. 1, the baby carrier holder assembly 10 includes a base assembly 100, a support assembly 200, an attachment assembly 300, and a holding assembly 400. In general, the support assembly 200 supports the attachment assembly 300 and the holding assembly 400, and the connection assembly 100 secures the support assembly 200 and enables the adjustment of several characteristics of the assembly 10 (e.g., its overall length). The holding assembly 400 facilitates the securing of a baby carrier BC to the assembly 10 and the attachment assembly 300 facilitates the attachment of the assembly 10 to another structure S (best seen in FIGS. 6B-6C). This will be described in detail in other sections. The assembly 10 also may include other components and elements as necessary for the assembly 10 to perform its functionalities.

The Base Assembly 100

Figure 2A:
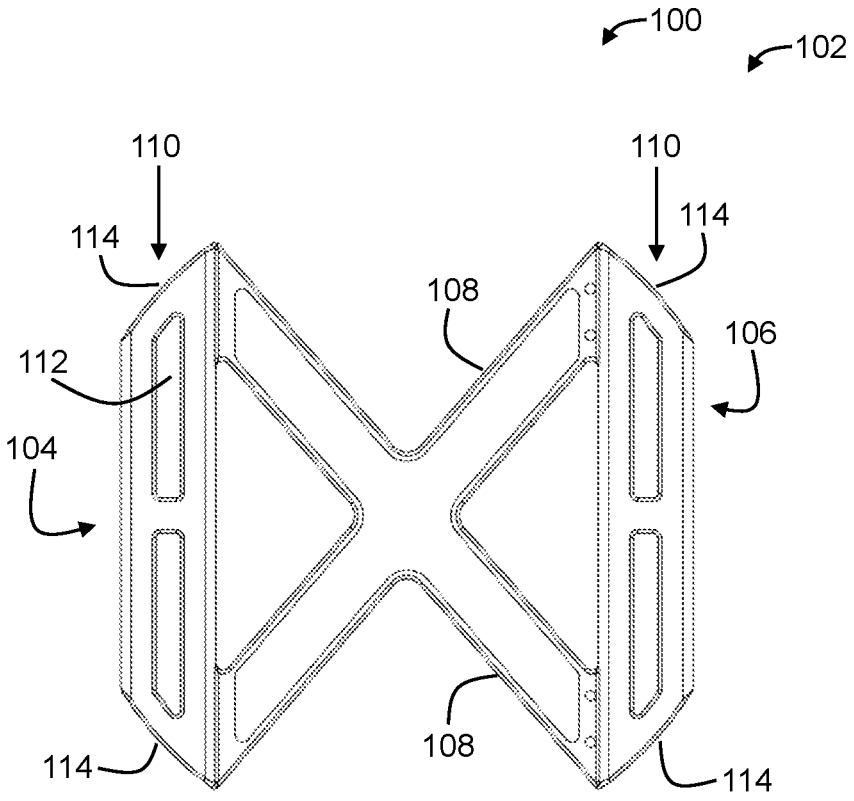
FIG. 2A shows aspects of a base assembly according to exemplary embodiments hereof.
Figure 2B:
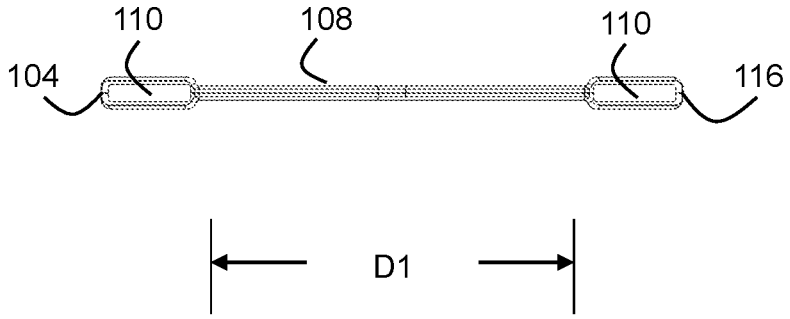
FIG. 2B shows aspects of a base assembly according to exemplary embodiments hereof.

In some embodiments as shown in FIGS. 2A-2B, the assembly 10 includes a base assembly 100 that generally supports and connects together the various elements of the support assembly 200.

In some embodiments, the base assembly 100 includes a bracket 102 configured to support a first channel support 104 and a second channel support 106. Using the frame of reference of FIG. 2A, the first and second channel supports 104, 106 are positioned left and right, are generally upright, and are separated by a separation distance D1, as shown in FIG. 2B.

Figure 3A:
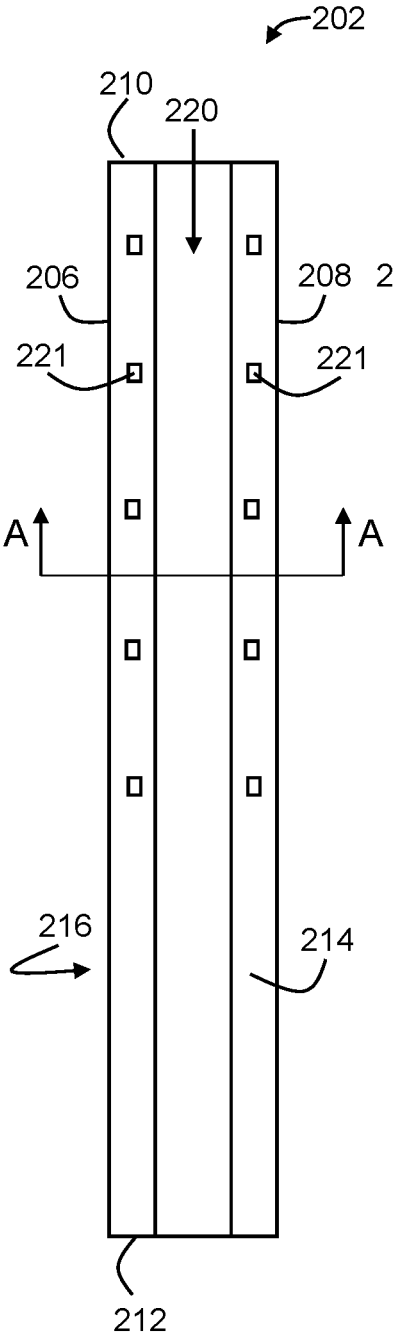
FIG. 3A shows aspects of an elongate support member according to exemplary embodiments hereof.

Each channel support 104, 106 includes a channel 110 that extends from the upper end of the channel support 104, 106 to the lower end of the support 104, 106. As will be described in other sections, the first and second channel supports 104, 106 are adapted to receive and support the first and second elongate support members 202 as shown in FIG. 3A within their respective channels 110. The body of each channel support 104, 106 may include cutouts 112 that extend from outside the channel supports 104, 106 to the inner channels 110 that may facilitate the length adjustment of the support assembly 200 as described in other sections. The cutouts 112 also may reduce the amount of material used to form the supports 104, 106 and the overall weight of the supports 104, 106, but this may not be required. In some non-limiting embodiments, there may be two cutouts 112 in each channel support 104,106.

In some embodiments, the bracket 102 includes one or more bracket supports 108 attached to and extending between the first and second channel supports 104, 106. The bracket supports 108 are configured to support the first and second support channels 104, 106 at the desired separation distance D1 from one another and in a generally upright position.

In some embodiments, the bracket supports 108 are configured in a cross or "X" configuration extending between the first and second support channels 104, 106 as shown in FIG. 2A. In other embodiments, the bracket supports 108 may be in other configurations such as straight-across or in other suitable configurations. It is understood that the scope of the base assembly 100 is not limited in any way by the configuration of the bracket supports 108 extending between the first and second support channels 104, 106.

In some embodiments, the base assembly 100 includes upper left and right and lower left and right chamfers 114 (e.g., in the tops and bottoms of the left and right channel supports 104, 106). The chamfers 114 may enable additional access to the elongate supports 202 in the area of the chamfers 114 while reducing the amount of material used to form the assembly 10.

The base assembly 100 may comprise any suitable materials such as, without limitation, plastic, metal, composite materials, other materials, and any combinations thereof. In some embodiments, the base assembly 100 may be manufactured as two or more portions and then combined to form the base 100. Alternatively, the base assembly 100 may be manufactured as a single piece.

The Support Assembly 200

Figure 3B:
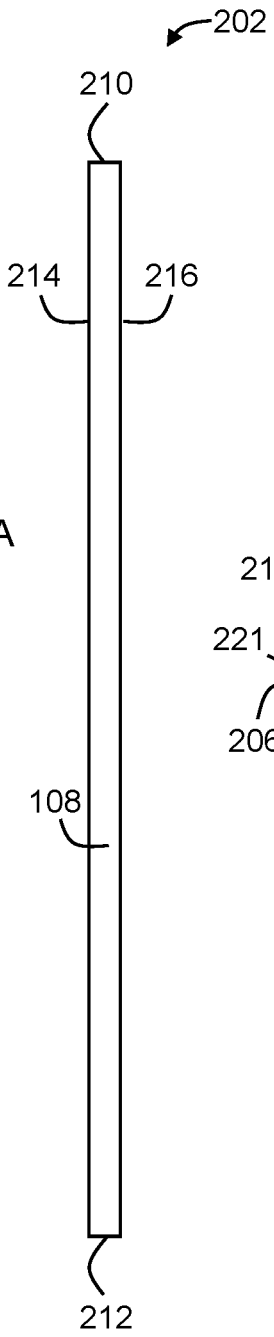
FIG. 3B shows aspects of an elongate support member according to exemplary embodiments hereof.
Figure 3C:
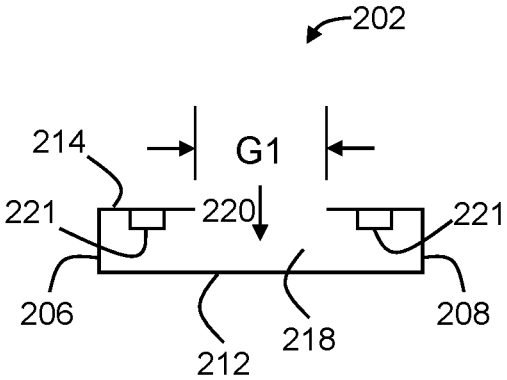
FIG. 3C shows aspects of an elongate support member according to exemplary embodiments hereof.

In some embodiments as shown in FIGS. 3A-3C, the assembly 10 includes a support assembly 200 that includes one or more elongate support members 202. In some embodiments, the support assembly 200 includes a first elongate support member 202 adapted to be received and supported within the bracket's first channel 110, and a second elongate support member 202 adapted to be received and supported within the second channel support's second channel 110. The elongate support members 202 may be held within the channels 110 using detents, pressure fit, notches, screws, rivets, latches, adhesive, other types of attachment methods and any combinations thereof. As will be described below, each elongate support member 202 is adapted to be configured with a corresponding telescoping support member 222, which is shown in FIG. 4A.

In some embodiments as shown in FIGS. 3A-3C, each elongate support member 202 includes a left side 206, a right side 208, a top 210, a bottom 212, a front side 214, and a back side 216. As shown in FIG. 3C (cross-sectional view taken along the cutlines A-A of FIG. 3A), the left side 206, right side 208, front side 214, and back side 216 define an inner volume 218. As described below, the inner volume 218 is adapted to receive and secure the telescoping support members 222.

The front side 214 may include a gap 220 extending from the member's top 210 to the member's bottom 212 (or a portion thereof) thereby providing access to the member's inner volume 218 from the front 214. The front side 214 also may include one or more detents 221 on either side of the gap 220 and extending into the inner volume 218. As will be described in other sections, the gap 220 and the detents 221 may facilitate the positioning of the telescoping support members 222, as shown in FIG. 4A, within respective elongate support members 202.

Figure 4A:
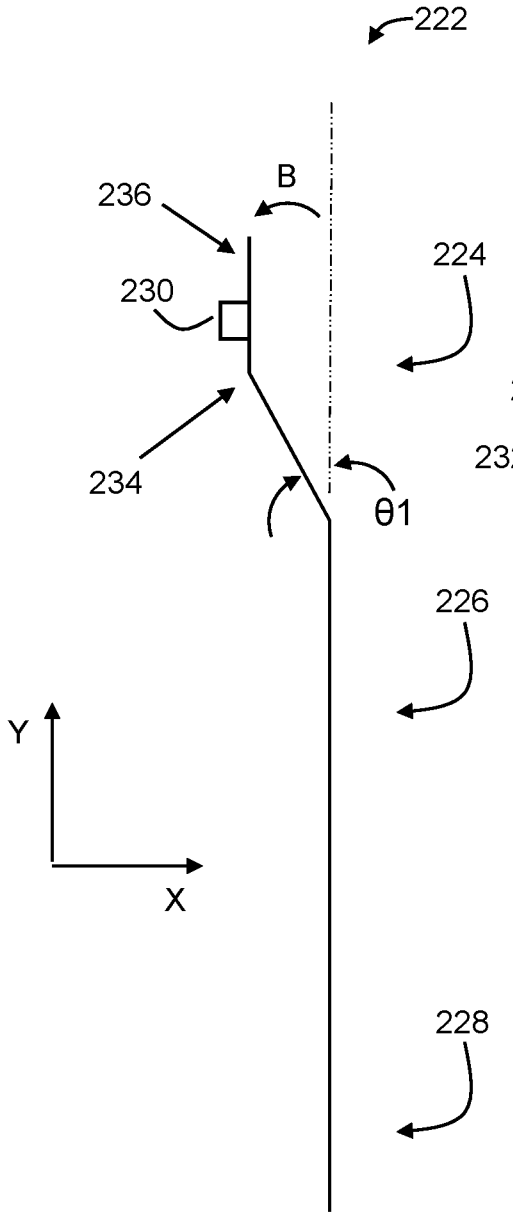
FIG. 4A shows aspects of a telescoping support member according to exemplary embodiments hereof.
Figure 4B:
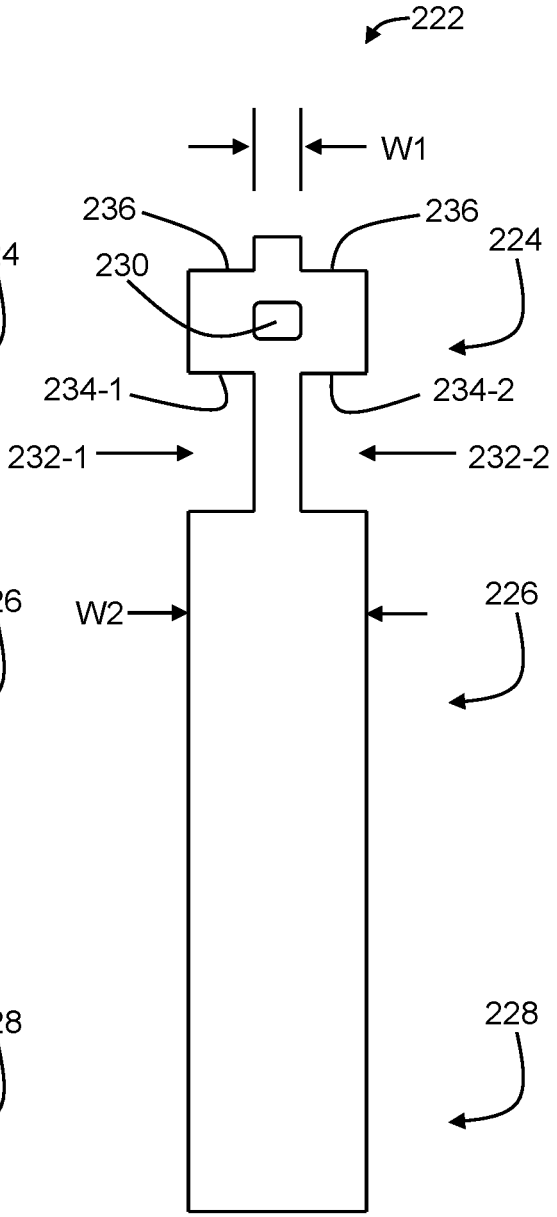
FIG. 4B shows aspects of a telescoping support member according to exemplary embodiments hereof.

In some embodiments as shown in FIGS. 4A-4B, the support assembly 200 includes one or more telescoping support members 222 adapted to be received into and held within corresponding elongate support members 202. As will be described below, each telescoping support member 222 is configured in a longitudinally overlapping arrangement with a corresponding elongate support member 202 such that movement of a telescoping support member 222 with respect to a corresponding elongate support member 202 may increase and/or decrease the overall length of the combined members 202, 222.

As shown in FIG. 4A, each telescoping support member 222 includes an upper portion 224, a middle portion 226, and a lower portion 228. The upper portion 224 is preferably oriented and biased outward in the direction of arrow B and at an offset angle θ1 with respect to the middle portion 226 (and the Y-axis) as shown in FIG. 4A. In this way, if the portion 224 is deflected in a direction opposite the arrow B it will tend to return to its offset angle θ1. Accordingly, it may be preferable that the upper portion 224 (and the middle portion 226) comprise spring steel or other suitable biasable materials.

As shown in FIG. 4B, the telescoping member's upper portion 224 includes left and right cutouts 232-1, 232-2, respectively, forming left and right lower shoulders 234-1, 234-2, respectively (collectively 234). The width W1 of the upper portion 224 in the area of the cutouts 232 is preferably equal to or less than the width G1 of the gap 220, as shown in FIG. 3C, in the front 214 of the elongate support member 202.

In addition, the upper portion 224 also includes left and right upper shoulders 236 above and opposing the lower shoulders 234. The upper shoulders 236 may be formed by left and right cutouts or simply by the top of the member 222. In some embodiments, the width of the lower and upper shoulders 234, 236 as shown in FIG. 5C is generally equal to the width W2 shown in FIG. 4B of the member's middle portion 226. In this way, the lower and upper shoulders 234 may be wider than the width G1 of the gap 220 and may therefore be held within the member's inner volume 218 when configured therein.

Figure 5A:
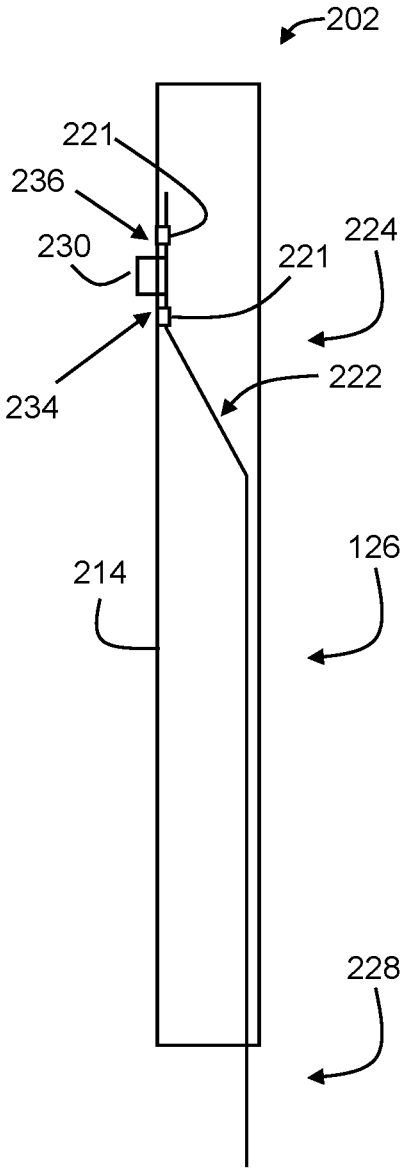
FIG. 5A shows aspects of an elongate support member and a telescoping support member in combination according to exemplary embodiments hereof.
Figure 5B:
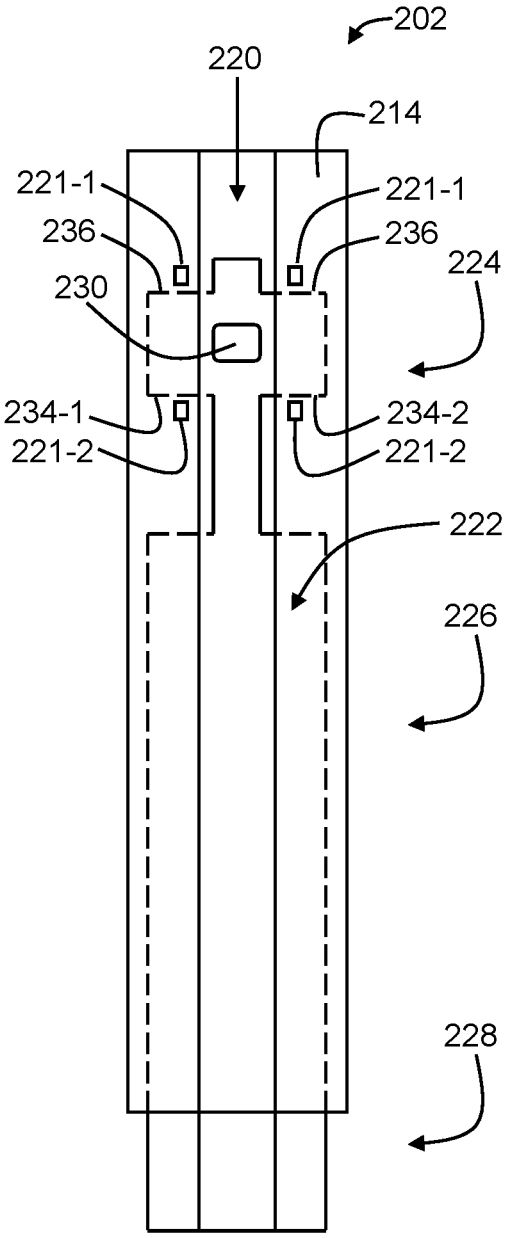
FIG. 5B shows aspects of an elongate support member and a telescoping support member in combination according to exemplary embodiments hereof.
Figure 5C:
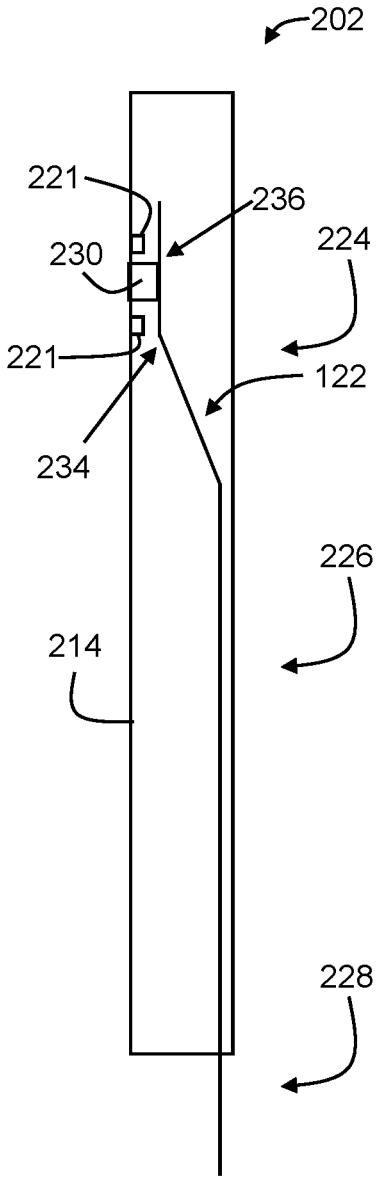
FIG. 5C shows aspects of an elongate support member and a telescoping support member in combination according to exemplary embodiments hereof.

In some embodiments, the upper portion 224 includes a button 230 as shown in FIGS. 5A-5B extending outward from its front surface in the area between the lower shoulders 234 and the upper shoulders 236. It may be preferable that the width of the button 230 be generally equal to or less than the width G1 of the gap 220. In this way, with the telescoping support member 222 configured withing an elongate support member 202, the button 230 may protrude through the gap 220 but the lower and upper shoulders 234, 236 may not.

In some embodiments as shown in FIGS. 5A-5C, the telescoping support member 222 is longitudinally received into and held within the support member's inner volume 220. As shown in FIG. 5B, because the upper portion 224 of the member 222 is biased outwardly, the lower and upper shoulders 234, 236 are generally held against the inner wall of the support member's front 214 while the button 230, being less wide than the gap 220, protrudes through the gap 220. In this configuration, the middle and lower portions 226, 228 of the member 222 are generally held against the opposing inner wall of the support member's back 216, as shown in FIG. 3B.

In some embodiments, a first pair of detents 221-1, as shown in FIGS. 3A-3C, may be positioned directly above the upper shoulders 236 on either side of the gap 220 and a second pair of detents 221-2 may be positioned directly below the lower shoulders 234 on either side of the gap 220. With the lower and upper shoulders 234, 236 biased against the inner wall adjacent the detents 221, the detents 221 may obstruct the shoulders 234, 236 thereby locking the telescoping support member 222 in place.

To release the shoulders 234, 236 from the detents 221, the button 230 may be pressed inward (into the support member's inner volume 218) so that the shoulders 234, 236 no longer abut against the member's inner wall and may thereby clear the detents 221. With the button 230 adequately pressed inward, the telescoping support member 222 may be moved longitudinally (e.g., down, or up) with respect to the elongate support member 202 to effectively lengthen or shorten the overall length of the combined members 202, 222. The button 230 may then be released and the biasing of the member's upper portion 224 may cause the lower and upper shoulders 234, 236 to engage the inner surface of the elongate member's front 214 to be held by adjacent detents 221.

As shown in FIG. 3A, detents 221 may be positioned on either side of the gap 220 (e.g., in pairs) at spacings along the longitudinal length of each support member 202. In this way, a corresponding telescoping member 222, as shown in FIG. 4A, may be locked at different positions along the member 202 by aligning the shoulders 234, 236 between the detents 221. It may be preferable that the detents 221 be separated at spacings generally equal to or slightly larger than the distance between the telescoping member's lower and upper shoulders 234, 236 so that the shoulders 234, 236 may engage particular pairs of detents 221 in unison.

The Attachment Assembly 300

In one exemplary embodiment hereof as shown in FIGS. 6A-6D, the assembly 10 includes an attachment assembly 300. In some embodiments, the attachment assembly 300 includes one or more attachment members 302 generally configured with the top ends 210 of the elongate support members 202.

Figure 6A:
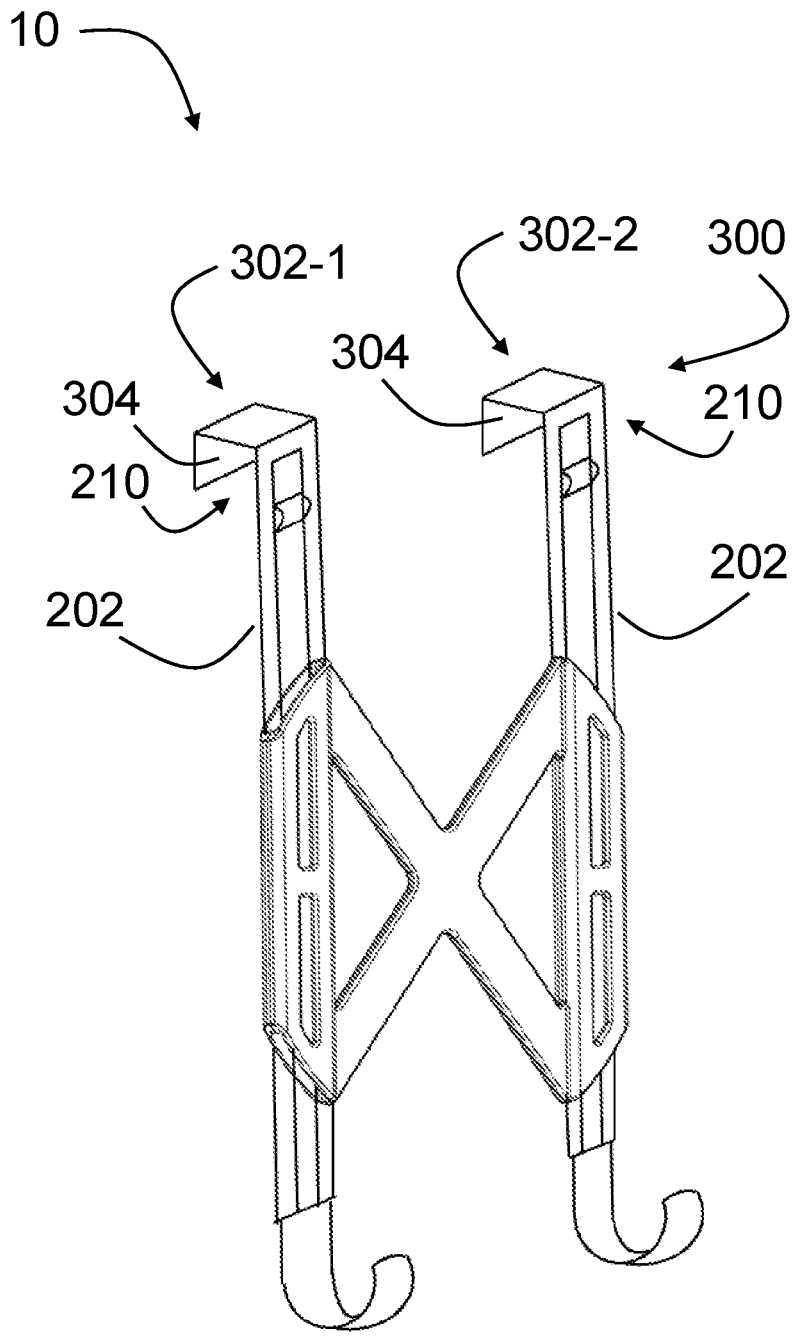
FIG. 6A shows aspects of a holder assembly configured with a baby carrier and a door according to exemplary embodiments hereof.

For example, as shown in FIG. 6A, in one embodiment, the assembly 10 includes two elongate support members 202 and two attachment members 302, with the first attachment member 302-1 configured with the top end 210 of the first elongate support member 202, and the second attachment member 302-2 configured with the top end 210 of the second elongate member 202.

Figure 6B:
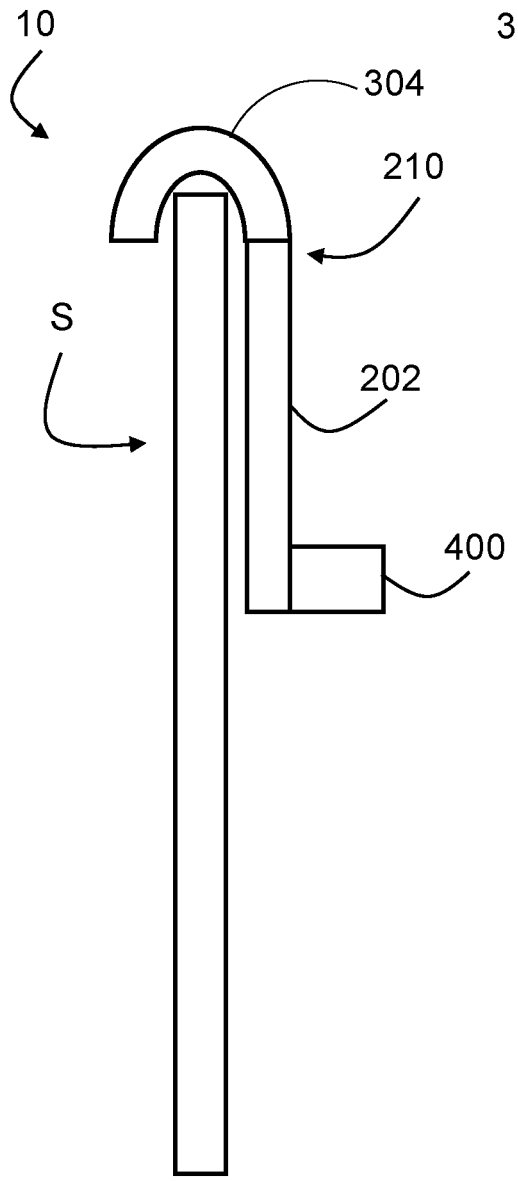
FIG. 6B shows aspects of a holder assembly configured with a baby carrier and a door according to exemplary embodiments hereof.
Figure 6C:
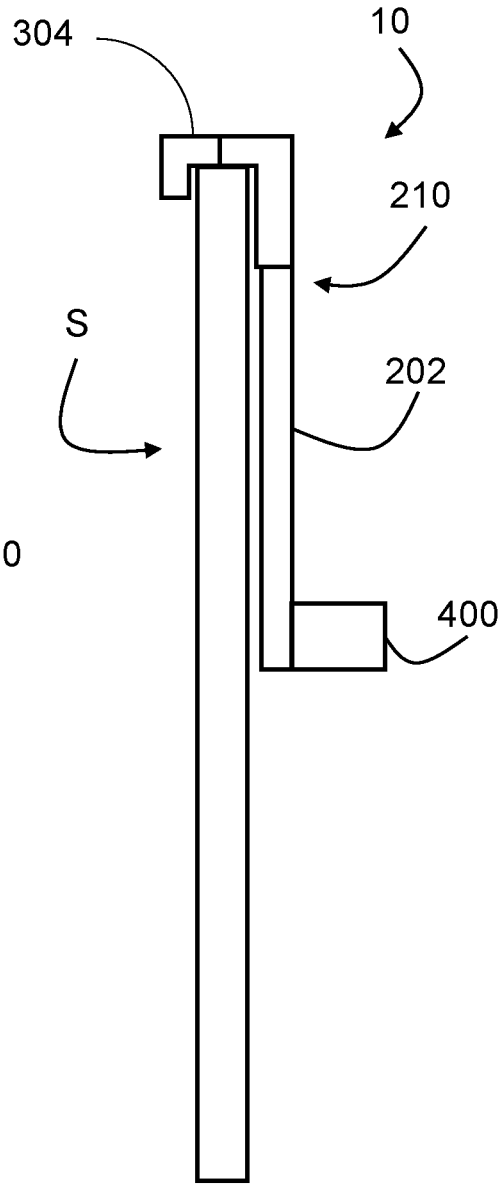
FIG. 6C shows aspects of a holder assembly configured with a baby carrier and a door according to exemplary embodiments hereof.

In some embodiments, each attachment member 302 includes a hook 304 as shown in FIG. 6A. In some embodiments, the hooks 304 are adapted to hook onto another structure S as shown in FIGS. 6B-6C in order to secure the assembly 10 to the structure S. For example, in some embodiments as shown in FIGS. 6B and 6C, the structure S may include a door and the hooks 304 may be adapted to hook over the top of a door S. In these examples, the width of the hooks 304 may be chosen to be wider than the width of the door S so that the hooks 304 may fully extend over the top width of the door S to engage the door thereby.

In some embodiments as shown in FIG. 6B, the hooks 304 may include an arc shaped side profile (curved contour) while in other embodiments as shown in FIG. 6C, the hooks 304 may include right-angled hooks 304. It is understood that the hooks 304 may include hooks of any form and that the scope of the assembly is not limited in any way by the shape or forms of the hooks 304.

Figure 6D:
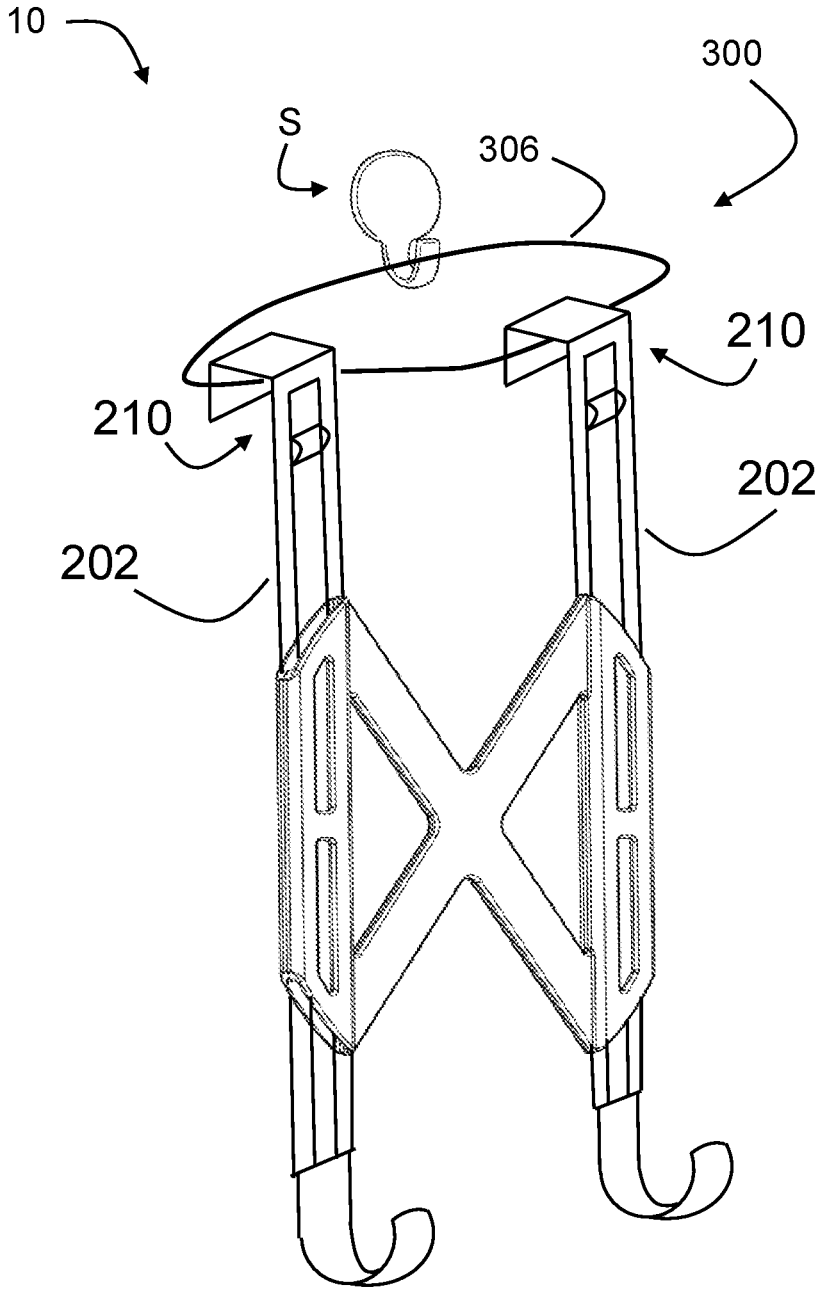
FIG. 6D shows aspects of a holder assembly configured with a baby carrier and a door according to exemplary embodiments hereof.

In another embodiment as shown in FIG. 6D, the attachment assembly 300 may include a bridge member 306 that may be adapted to engage a structure S such as a coat hook S configured with the back of a door or coat rack S. The bridge member 306 may include a loop, a strap, a bridge, a bar or other type of structure that may generally extend from the top end 210 of a first elongate member 202 to the top end 210 of a second elongate member 202. In this way, the top ends 210 may be connected via the bridge member 306, and the bridge member 306 may be adapted to loop over the coat hook S.

In some embodiments, the bridge member 306 may be configured directly with the top ends 210, and in other embodiments, the bridge member 306 may be configured with hooks 304 that may be configured with the top ends 210. It is understood that the bridge member 306 may include any type of element that may be generally configured with the top portion of the attachment assembly 300 and that may be adapted to engage with a coat hook configured on the back of a door S, on a coat rack S, and/or with any other type of structure S. The bridge member 306 may be removeable and thereby removed when not needed. In other embodiments, the bridge member 306 may be fixed.

The Holding Assembly 400

Figure 7A:
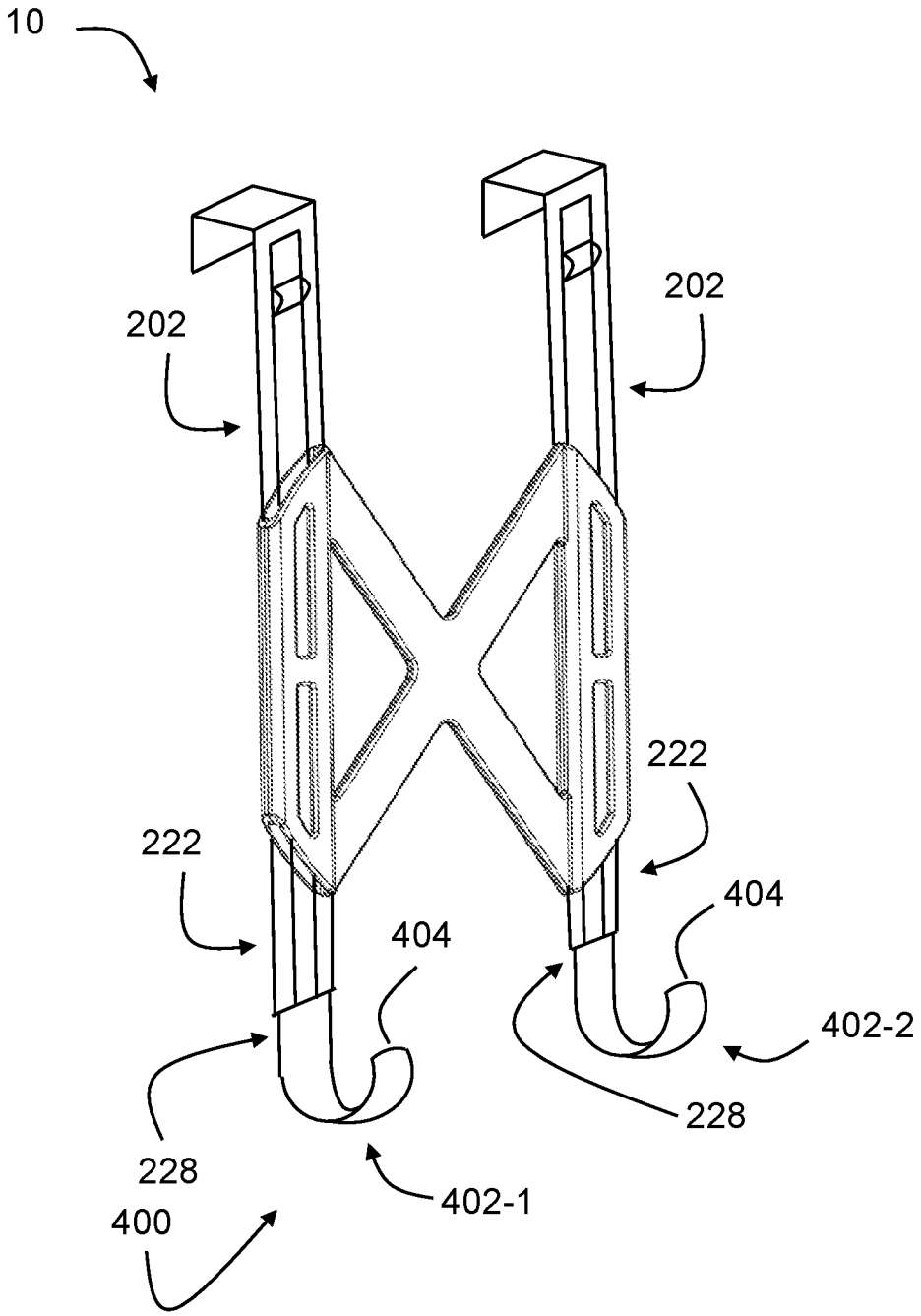
FIG. 7A shows aspects of an attachment assembly configured with a baby carrier and a door according to exemplary embodiments hereof.
Figure 7B:
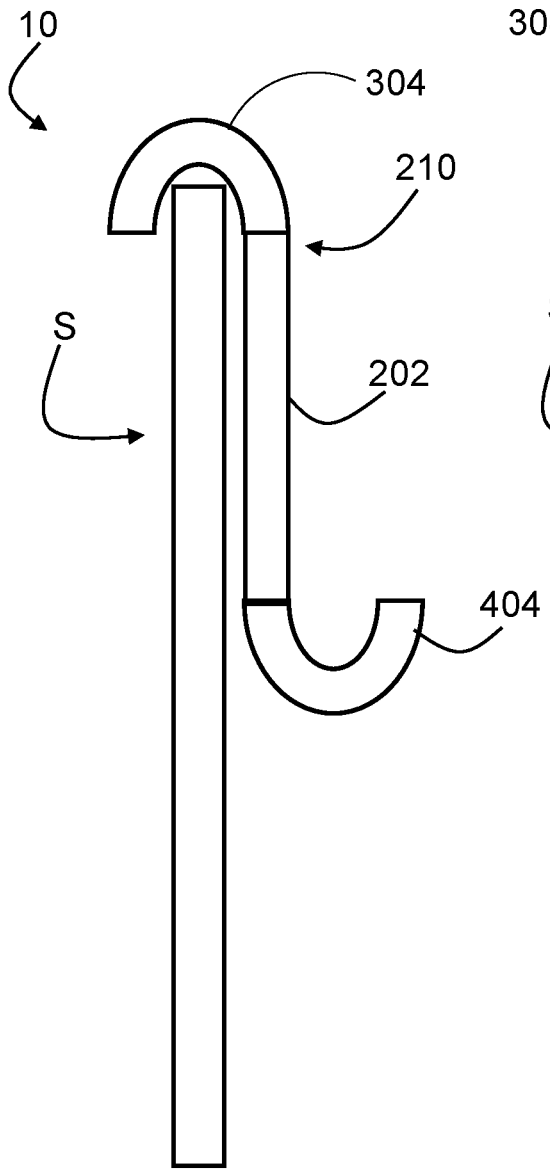
FIG. 7B shows aspects of an attachment assembly configured with a baby carrier and a door according to exemplary embodiments hereof.
Figure 7C:
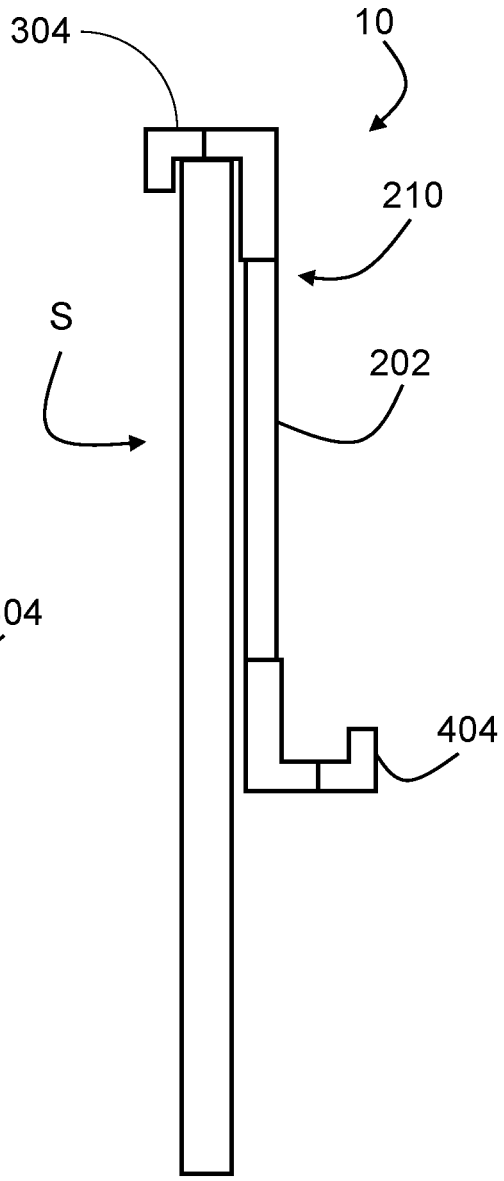
FIG. 7C shows aspects of an attachment assembly configured with a baby carrier and a door according to exemplary embodiments hereof.

In one exemplary embodiment hereof as shown in FIGS. 7A-7C, the assembly 10 may include a holding assembly 400. In some embodiments, the holding assembly 400 includes one or more holding members 402 configured with the bottom ends 228 of the telescoping support members 222.

For example, as shown in FIG. 7A, in one embodiment, the assembly 10 includes two telescoping support members 222 (each configured within a corresponding elongate support member 202) and two holding members 402, the first holding member 402-1 configured with the bottom end 228 of the first telescoping member 222, and the second holding member 402-2 configured with the bottom end 228 of the second elongate member 222.

Figure 8:
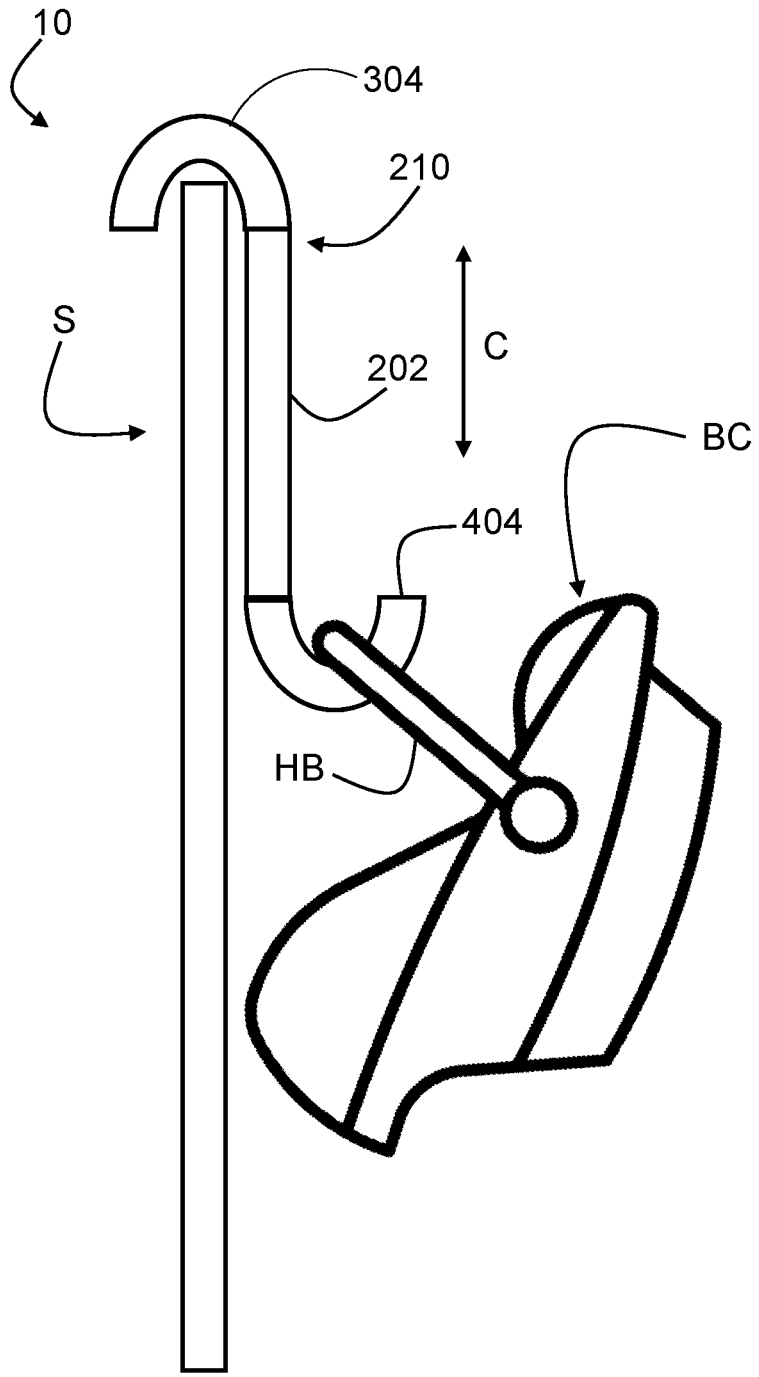
FIG. 8 shows aspects of a holder assembly configured with a baby carrier and a door according to exemplary embodiments hereof.

In some embodiments, each holding member 402 includes a hook 404 adapted to hook onto a baby carrier BC in order to secure the baby carriage BC to the assembly 10 (as shown in FIG. 8).

In some embodiments as shown in FIG. 7B, the hooks 404 may include an arc shaped side profile (curved contour) while in other embodiments as shown in FIG. 7C, the hooks 404 may include right-angled hooks 404. It is understood that the hooks 404 may include hooks of any form and that the scope of the assembly is not limited in any way by the shape or forms of the hooks 404.

In some embodiments, the hooks 404 include locking mechanisms (e.g., a spring-loaded hinged gate as often found on carabiners and the like) so that the hooks 404 may be locked in place around a portion of the baby carrier (e.g., around a holding bar HB as shown in FIG. 8) when in use and subsequently unlocked to remove the baby carrier BC from the assembly 10.

Note that it may be preferable that the hooks 404 of the holding assembly 400 extend in an opposite direction with respect to the hooks 304 of the attachment assembly 300.

Figure 7D:
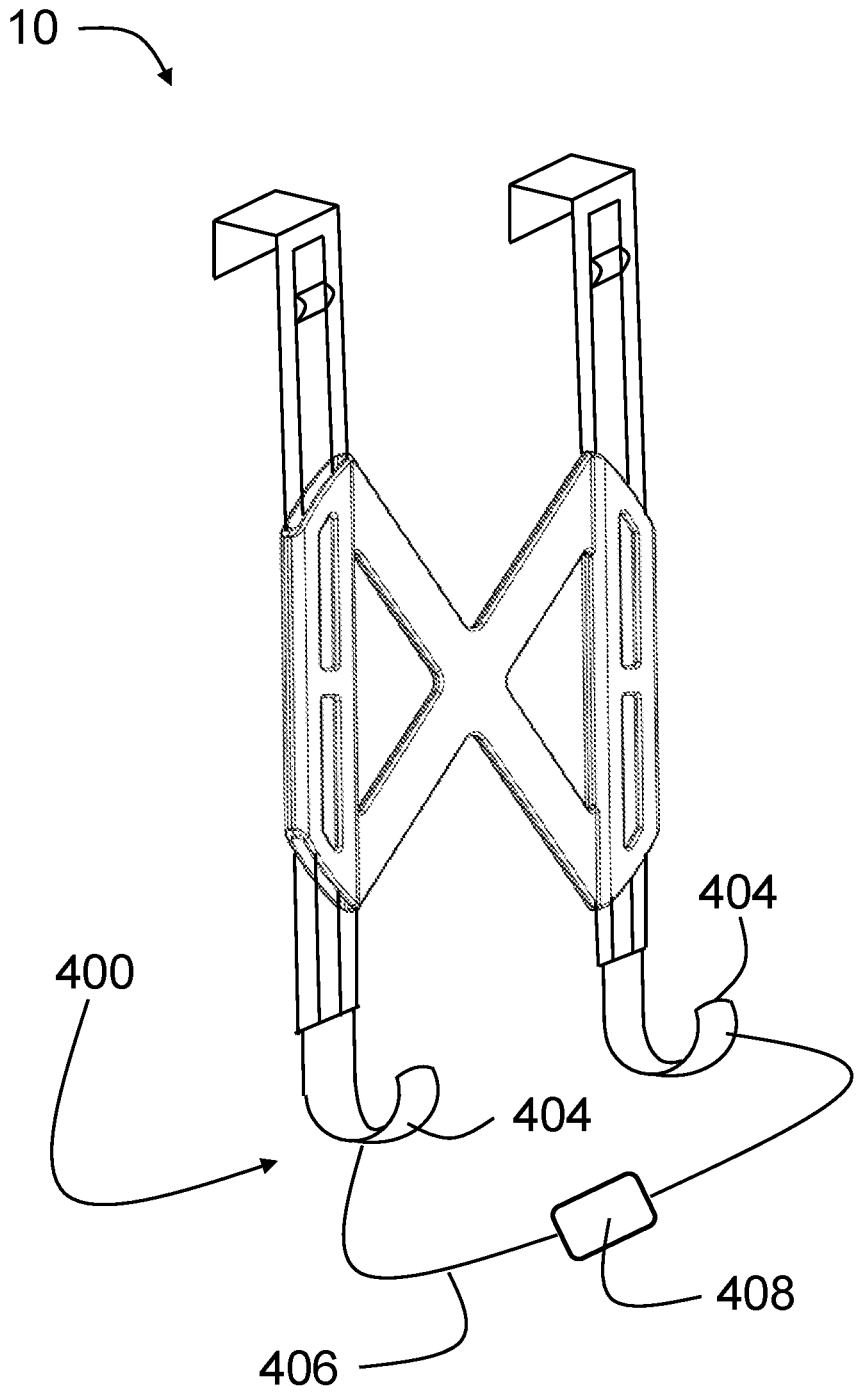
FIG. 7D shows aspects of an attachment assembly configured with a baby carrier and a door according to exemplary embodiments hereof.

In another embodiment as shown in FIG. 7D, the holder assembly 400 may include a loop member 406 that may be adapted to engage a portion of the baby carrier BC. For example, the loop member 406 may loop around a holder bar HB, around the body of the baby carrier BC, or around other portions and/or elements of the baby carrier BC.

In other embodiments, the loop member 406 may engage with the confinement straps of the baby carrier BC typically used to secure a baby within the carrier BC. The confinement straps may include shoulder straps, torso straps, waist straps, hip straps, groin straps and other types of straps.

The loop member 406 may include a loop, a strap, a chain, a rope, other types of elements comprising any types of adequate materials and any combination thereof. In some embodiments, the loop member 406 may generally extend from the bottom end 228 as shown in FIG. 4B of a first telescoping member 222 to the bottom end 228 of a second telescoping member 222.

In some embodiments, the loop member 406 may include a buckle 408 as shown in FIG. 7D and/or other mechanisms that may enable the loop member 406 to be opened so that it may be looped around an element of the baby carrier BC, and subsequently closed to secure the loop member 406 around the corresponding element.

In some embodiments, the loop member 406 may be configured directly with the bottom ends 228, and in other embodiments, the loop member 406 may be configured with hooks 404 that may be configured with the bottom ends 228. The loop member 406 may be fixed or removeable. It is understood that the loop member 406 may include any type of element that may be generally configured with the lower portion of the holding assembly 400 and that may be adapted to engage with any element of the baby carrier BC to secure the baby carrier BC to the assembly 10.

In Use

In some embodiments, the assembly 10 is used to secure a baby carrier BC to another structure S for storage, as shown in FIG. 8.

In one example of this as shown in FIG. 8, the following actions may be followed while using the assembly 10:

In a first step, the attachment mechanisms 302 (e.g., the hooks 304) of the assembly 10 may be placed over the top of a door S with the support assembly 200 hanging down the side of the door S upon which to store the baby carrier BC. Alternatively, a bridge member 306 may be utilized to attach the assembly 10 to a coat hook on the back of the door or on a coat rack. At a second step, the length of the support assembly 200 may be adjusted by depressing the button 230 of the telescoping support member 222 and moving the member 222 longitudinally within the inner volume 218 of its corresponding elongate support member 202 to increase and/or decrease the overall length of the combined members 102, 222. This is represented by the arrow C in FIG. 8. This is to set the vertical position of the holding assembly 400

(e.g., the hooks 402) to a desired height. At a third step, the baby carrier BC (e.g., the holder bar HB) may be placed on the holding assembly 400 (e.g., the hooks 402) to store the baby carrier BC. Alternatively, a loop member 406 may be utilized to secure the baby carrier to the assembly 10 to store the baby carrier BC. These above-described steps may then be performed in reverse in order to remove the baby carrier BC and the assembly 10 from the door S.

It is understood that any aspect and/or element of any embodiment of the assembly 10 described herein or otherwise may be combined in any way to form additional embodiments of the assembly 10 all of which are within the scope of the assembly 10.

It also is understood that the FIGS. 1-8 are not necessarily drawn to scale and/or in proportion with respect to one another.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A baby carrier holder assembly comprising:

a base including a first side and a second side, a first support channel configured on the first side and a second support channel configured on the second side;

a first elongate support member including a first end and a second end and configured within the first support channel and including at least one first detent;

a second elongate support member including a first end and a second end and configured within the second support channel and including at least one second detent;

a first telescoping support member including a first end and a second end and in a first overlapping arrangement with the first elongate support member within the first support channel, the first telescoping support member including at least one first shoulder adapted to releasably engage the at least one first detent;

a second telescoping support member including a first end and a second end and in a second overlapping arrangement with the second elongate support member within the second support channel, the second telescoping support member including at least one second shoulder adapted to releasably engage the at least one second detent;

a first attachment member coupled to the first end of the first elongate support member, and a second attachment member coupled to the first end of the second elongate support member; and a first holding member coupled to the second end of the first telescoping support member, and a second holding member coupled to the second end of the second telescoping support member;

wherein the first and/or second attachment members are adapted to attach to a separate structure;

wherein the first and/or second holding members are adapted to attach to a baby carrier.

2. The baby carrier holder assembly of claim 1 wherein an engagement of the at least one first shoulder of the first telescoping support member with the at least one first detent of the first elongate support member locks the first elongate support member and the first telescoping support member in the first overlapping arrangement, and/or an engagement of the at least one second shoulder of the second telescoping support member with the at least one second detent of the second elongate support member locks the second elongate support member and second telescoping support member in the second overlapping arrangement.

3. The baby carrier holder assembly of claim 1 wherein the first telescoping support member includes a first bias that positions the at least one first shoulder into alignment with the at least one first detent of the first elongate support member, and/or the second telescoping support member includes a second bias that positions the at least one second shoulder into alignment with the at least one second detent of the second elongate support member.

4. The baby carrier holder assembly of claim 3 wherein the first bias is near the first end of the first telescoping support member, and/or the second bias is near the first end of the second telescoping support member.

5. The baby carrier holder assembly of claim 3 wherein the first telescoping support member includes a first button adjacent the at least one first shoulder that when pressed displaces the at least one first shoulder from the alignment with the at least one first detent, and/or the second telescoping support member includes a second button adjacent the at least one second shoulder that when pressed displaces the at least one second shoulder from the alignment with the at least one second detent.

6. The baby carrier holder assembly of claim 1 wherein the first attachment member includes at least one of a hook and a strap, and/or the second attachment member includes at least one of a hook and a strap.

7. The baby carrier holder assembly of claim 1 wherein the first holder member includes at least one of a hook and a strap, and/or the second attachment member includes at least one of a hook and a strap.

8. The baby carrier holder assembly of claim 1 wherein the at least one first shoulder is formed by at least one first cutout in the first telescoping member, and/or the at least one second shoulder is formed by at least one second cutout in the second telescoping member.

9. The baby carrier holder assembly of claim 1 wherein the first elongate support member includes a first inner volume extending from its first end to its second end and the first telescoping support member is positioned at least partially within the first inner volume to form the first overlapping arrangement, and/or the second elongate support member includes a second inner volume extending from its first end to its second end and the second telescoping support member is positioned at least partially within the second inner volume to form the second overlapping arrangement.

10. The baby carrier holder assembly of claim 9 wherein the first elongate support member includes a first slot extending at least partially from its first end to its second end that provides access to the first telescoping support member, and/or the second elongate support member includes a second slot extending at least partially from its first end to its second end that provides access to the second telescoping support member.

11. The baby carrier holder assembly of claim 10 wherein the first telescoping support member includes a first button adapted to extend through the first slot, and/or the second telescoping support member includes a second button adapted to extend through the second slot.

12. The baby carrier holder assembly of claim 11 wherein the first button is adapted to transition from a first position that locks the position of the first telescoping support member in relation to the first elongate support member to a second position that unlocks the position of the first telescoping support member in relation to the first elongate support member, and/or the second button is adapted to transition from a third position that locks the position of the second telescoping support member in relation to the second elongate support member to a second position that unlocks the position of the second telescoping support member in relation to the second elongate support member.

13. The baby carrier holder assembly of claim 1 wherein the first attachment member and the first holding member extend outward from the assembly in opposite directions, and/or the second attachment member and the second holding member extend outward from the assembly in opposite directions.

14. A baby carrier holder assembly comprising:

a base including a first side and a second side, a first support channel configured on the first side and a second support channel configured on the second side;

a first elongate support member including a first end and a second end and a portion between the first end and the second end configured within the first support channel, the first elongate support member including a first hook coupled to its first end and at least one first detent;

a second elongate support member including a first end and a second end and a portion between the first end and the second end configured within the second support channel, the second elongate support member including a second hook coupled to its first end and at least one second detent;

a first telescoping support member including a first end and a second end, its first end in a first overlapping arrangement with the first elongate support member within the first support channel, the first telescoping support member including at least one first shoulder adapted to releasably engage the at least one first detent and a third hook coupled to its second end;

a second telescoping support member including a first end and a second end, its first end in a second overlapping arrangement with the second elongate support member within the second support channel, the second telescoping support member including at least one second shoulder adapted to releasably engage the at least one second detent and a fourth hook coupled to its second end;

wherein the first hook and/or second hook is adapted to attach to a separate structure;

wherein the third hook and/or fourth hook is adapted to attach to a baby carrier.

15. The baby carrier holder assembly of claim 14 wherein the first telescoping support member includes a first bias that positions the at least one first shoulder into alignment with the at least one first detent of the first elongate support member, and/or the second telescoping support member includes a second bias that positions the at least one second shoulder into alignment with the at least one second detent of the second elongate support member.

16. The baby carrier holder assembly of claim 15 wherein the first telescoping support member includes a first button adjacent the at least one first shoulder that when pressed displaces the at least one first shoulder from the alignment with at least one first detent, and/or the second telescoping support member includes a second button adjacent the at least one second shoulder that when pressed displaces the at least one second shoulder from the alignment with at least one second detent.

17. The baby carrier holder assembly of claim 14 wherein the first elongate support member includes a first inner volume extending from its first end to its second end and the first telescoping support member is positioned at least partially within the first inner volume to form the first overlapping arrangement, and/or the second elongate support member includes a second inner volume extending from its first end to its second end and the second telescoping support member is positioned at least partially within the second inner volume to form the second overlapping arrangement.

18. The baby carrier holder assembly of claim 17 wherein the first elongate support member includes a first slot extending at least partially from its first end to its second end that provides access to the first telescoping support member, and/or the second elongate support member includes a second slot extending at least partially from its first end to its second end that provides access to the second telescoping support member.

19. The baby carrier holder assembly of claim 18 wherein the first telescoping support member includes a first button adapted to extend through the first slot, and/or the second telescoping support member includes a second button adapted to extend through the second slot.

20. The baby carrier holder assembly of claim 19 wherein the first button is adapted to transition from a first position that locks the position of the first telescoping support member in relation to the first elongate support member to a second position that unlocks the position of the first telescoping support member in relation to the first elongate support member, and/or the second button is adapted to transition from a third position that locks the position of the second telescoping support member in relation to the second elongate support member to a second position that unlocks the position of the second telescoping support member in relation to the second elongate support member.

* * * * *